US007538687B2

(12) United States Patent
McKenna

(10) Patent No.: US 7,538,687 B2
(45) Date of Patent: May 26, 2009

(54) EMERGENCY WARNING SYSTEM FOR APPROACH OF RIGHT OF WAY VEHICLE

(76) Inventor: Louis H McKenna, Box 234, 2355 Fairview Ave., Roseville, MN (US) 55113

( * ) Notice: Subject to any disclaimer, the term of this patent is extended or adjusted under 35 U.S.C. 154(b) by 67 days.

(21) Appl. No.: 11/504,867

(22) Filed: Aug. 16, 2006

(65) Prior Publication Data

US 2007/0046499 A1 Mar. 1, 2007

Related U.S. Application Data

(63) Continuation-in-part of application No. 11/435,238, filed on May 15, 2006.

(60) Provisional application No. 60/713,868, filed on Sep. 1, 2005.

(51) Int. Cl.
*G08G 1/00* (2006.01)

(52) U.S. Cl. ..... 340/902; 340/903; 340/905; 340/901

(58) Field of Classification Search ..... 340/903, 340/905, 901, 902; 701/35, 36, 29
See application file for complete search history.

(56) References Cited

U.S. PATENT DOCUMENTS

| | | | | |
|---|---|---|---|---|
| 4,648,572 | A | 3/1987 | Sokol | |
| 4,704,610 | A | 11/1987 | Smith et al. | |
| 4,836,482 | A | 6/1989 | Sokol | |
| 5,111,183 | A | 5/1992 | Wang | |
| 5,111,207 | A * | 5/1992 | Allen | 342/20 |
| 5,187,476 | A | 2/1993 | Hamer | |
| 5,202,683 | A | 4/1993 | Hamer et al. | |
| 5,276,703 | A | 1/1994 | Budin et al. | |
| 5,495,243 | A | 2/1996 | McKenna | |
| 5,539,398 | A | 7/1996 | Hall et al. | |
| 5,550,718 | A | 8/1996 | Shy | |
| 5,602,739 | A | 2/1997 | Haagenstad et al. | |
| 5,621,571 | A | 4/1997 | Bantli et al. | |
| 5,631,627 | A | 5/1997 | Chou | |
| 5,657,008 | A | 8/1997 | Bantli | |
| 6,094,148 | A | 7/2000 | Henry et al. | |
| 6,252,519 | B1 | 6/2001 | McKenna | |
| 6,300,882 | B1 | 10/2001 | Inoue | |
| 6,449,540 | B1 * | 9/2002 | Rayner | 701/35 |
| 6,520,667 | B1 | 2/2003 | Mousseau | |
| 6,687,587 | B2 | 2/2004 | Kacel | |
| 6,728,612 | B1 | 4/2004 | Carver et al. | |
| 6,779,765 | B2 | 8/2004 | Zheng et al. | |
| 6,799,873 | B2 | 10/2004 | Fox | |
| 6,804,525 | B2 | 10/2004 | Davis et al. | |
| 6,819,939 | B2 | 11/2004 | Masamura | |
| 6,823,198 | B2 | 11/2004 | Kobayashi | |
| 6,845,316 | B2 | 1/2005 | Yates | |
| 6,853,910 | B1 | 2/2005 | Oesterling et al. | |
| 2007/0139221 | A1 | 6/2007 | Falvey | |

* cited by examiner

*Primary Examiner*—Daryl Pope

(57) ABSTRACT

A common inexpensive device such as an automotive internal rear view mirror, cell phone, CHMBL (center high mounted brake light), license plate or stand-alone housing incorporates an emergency warning system to detect a predefined signal emitted by an right of way vehicle such as an ambulance, police car, fire engine, or train. The right of way vehicle sends out a specific predefined signal to a predefined area. The specific predefined signal is picked up by a receiver of the present emergency warning system. Then, after verification of the specific predefined signal, the emergency warning system emits a warning, preferably an audio warning.

8 Claims, 11 Drawing Sheets

EMERGENCY WARNING SYSTEM FOR APPROACH OF RIGHT OF WAY VEHICLE

This application is a continuation-in-part application of U.S. patent application Ser. No. 11/435,238 filed May 15, 2006 and claims the benefit thereof under 35 U.S.C. § 120. This application also claims the benefit under 35 U.S.C. 119 (e) of U.S. Provisional Patent Application No. 60/713,868 filed Sep. 1, 2005. U.S. patent application Ser. No. 11/435,238 filed May 15, 2006 and U.S. Provisional Patent Application No. 60/713,868 filed Sep. 1, 2005 are hereby incorporated by reference in their entireties into this application.

FIELD OF THE INVENTION

The present invention generally relates to emergency warning systems, particularly to emergency warning systems for approach of right of way vehicles, and specifically to such emergency warning systems housed partially or fully in common inexpensive objects such as license plates, internal rear view mirrors, cell phones, and CHMBLs (center high mounted brake light or auxiliary or third rear brake light) or housed partially or fully in an automotive telematics unit or system or a stand-alone credit card sized apparatus.

BACKGROUND OF THE INVENTION

An IPOD® ear plug in one ear and a cell phone at the other ear is a most fashionable way to drive. Such a driver, however, can potentially block an emergency vehicle trying to thread its way through traffic.

Other reasons why drivers do not get out of the way are that the radio is turned up, the windows are up, or the internal rear view mirror is turned to reflect back to the driver such that the pulsing light of the ambulance is not seen, or the driver is relatively hard of hearing.

SUMMARY OF THE INVENTION

A feature of the present invention is the selection of a common object for housing an emergency warning system. Since the object is common, chances are maximized that the object will be in a vehicle that is approaching a dangerous situation.

Another feature of the present invention is the selection of an inexpensive object for housing an emergency warning system. Since the object is inexpensive, chances are maximized that the object will be in a vehicle that is approaching a dangerous situation.

Another feature of the present invention is the placement of an emergency warning system in a location or object that will maximize the chances that a driver can be made aware of a right of way vehicle for the safety of the driver.

Another feature of the present invention is the placement of an emergency warning system in a location or object that will maximize the chances that a driver cannot ignore a warning generated by the emergency warning system for the safety and health of others.

Another feature of the present invention is the selective placement of a feature of an emergency warning system in an automotive license plate.

Another feature of the present invention is the selective placement of a receiver of an emergency warning system in an automotive license plate.

Another feature of the present invention is the selective placement of a receiver and circuitry of an emergency warning system in an automotive license plate.

Another feature of the present invention is the selective placement of as many features as possible of an emergency warning system in an automotive license plate such that said emergency warning system is independent of the vehicle except for the provision of a speaker and/or display in the vehicle to sound or display a warning of the presence of an emergency vehicle.

Another feature of the present invention is the selective placement of a receiver of an emergency warning system in a device about the size of a credit card.

Another feature of the present invention is the selective placement of a receiver and speaker of an emergency warning system in a device about the size of a credit card.

Another feature of the present invention is the selective placement of an emergency warning system in an automotive internal rear view mirror.

Another feature of the present invention is the selective placement of an emergency warning system in a cell phone.

Another feature of the present invention is the selective placement of an emergency warning system in a CHMBL.

Another feature of the present invention is the selective placement of an emergency warning system in an automotive telematics unit or system.

Another feature of the present invention is the provision, in an automotive internal rear view mirror or in a cell phone or in a CHMBL or in another object, of an emergency warning system for picking up a right of way vehicle predefined signal, with the emergency warning system emitting an audio warning via a speaker in the automotive internal rear view mirror or cell phone or CHMBL when the right of way vehicle predefined signal has been picked up.

Another feature of the present invention is the provision, in an automotive internal rear view mirror or in a cell phone or in a CHMBL or in another object, of the emergency warning system including a receiver responsive to a right of way predefined signal that is a direct signal.

Another feature of the present invention is the provision, in an automotive internal rear view mirror or in a cell phone or in a CHMBL or in another object, of the emergency warning system including a radio frequency (RF) receiver responsive to the right of way predefined signal.

Another feature of the present invention is the provision, in an automotive internal rear view mirror or in a cell phone or in a CHMBL or in another object, of the emergency warning system including at least one of a 2.4 and 5.9 GHz receiver responsive to the right of way predefined signal.

Another feature of the present invention is the provision, in an automotive internal rear view mirror or in a cell phone or in a CHMBL or in another object, of the emergency warning system including a digital radio receiver responsive to the right of way predefined signal.

Another feature of the present invention is the provision, in an automotive internal rear view mirror or in a cell phone or in a CHMBL or in another object, of the emergency warning system including a cell phone receiver responsive to the right of way predefined signal.

Another feature of the present invention is the provision, in an automotive internal rear view mirror or in a cell phone or in a CHMBL or in another object, of the emergency warning system being responsive to a right of way vehicle predefined signal that includes information on the proximity of the right of way vehicle, information on the speed of the right of way vehicle, and/or information on the type of right of way vehicle.

Another feature of the present invention is the provision, in an automotive internal rear view mirror or in a cell phone or in a CHMBL or in another object, of the emergency warning system being always on even if a first battery in communication with the emergency warning system is powered off.

Another feature of the present invention is the provision in a telematics unit, of a processor, a global positioning system in communication with the processor, a microphone in communication with the processor, a speaker in communication with the processor, a cellular phone in communication with the processor, an emergency warning system capable of picking up a right of way vehicle predefined signal, with the emergency warning system being in communication with the processor, with the emergency warning system comprising a receiver responsive to said right of way vehicle predefined signal, and with the emergency warning system emitting, when said right of way vehicle predefined signal has been picked up, an audio warning via said speaker.

An advantage of the present invention is that the safety and health of the both the driver and others is maximized. A feature contributing to this advantage is the selection of a common and inexpensive object in which to house the emergency warning system. Since the object is common and inexpensive, chances are maximized that the object, and thus the emergency warning system, will be in the right car at the right time.

Another advantage of the present invention is cost. Since the inputs and outputs are minimized, the emergency warning system includes a minimum of parts and instructions. The inputs of the emergency warning system can be minimized because merely a specific predefined signal is sought. The outputs of the emergency warning system can be minimized because in one embodiment there is only an audio warning.

An advantage of the selection of a license plate for housing at least the receiver of an emergency warning system is that the license plate is on an exterior of the vehicle exposed to a maximum extent to a right of way predefined signal being emitted by an emergency vehicle.

An advantage of the selection of a credit card size housing for inclusion of an emergency warning system is that such a credit card sized housing may be carried in a wallet or purse or attached to a windshield or hung from a rear view mirror.

DETAILED DESCRIPTION

The Emergency Warning System 10 in General

Figure 1:
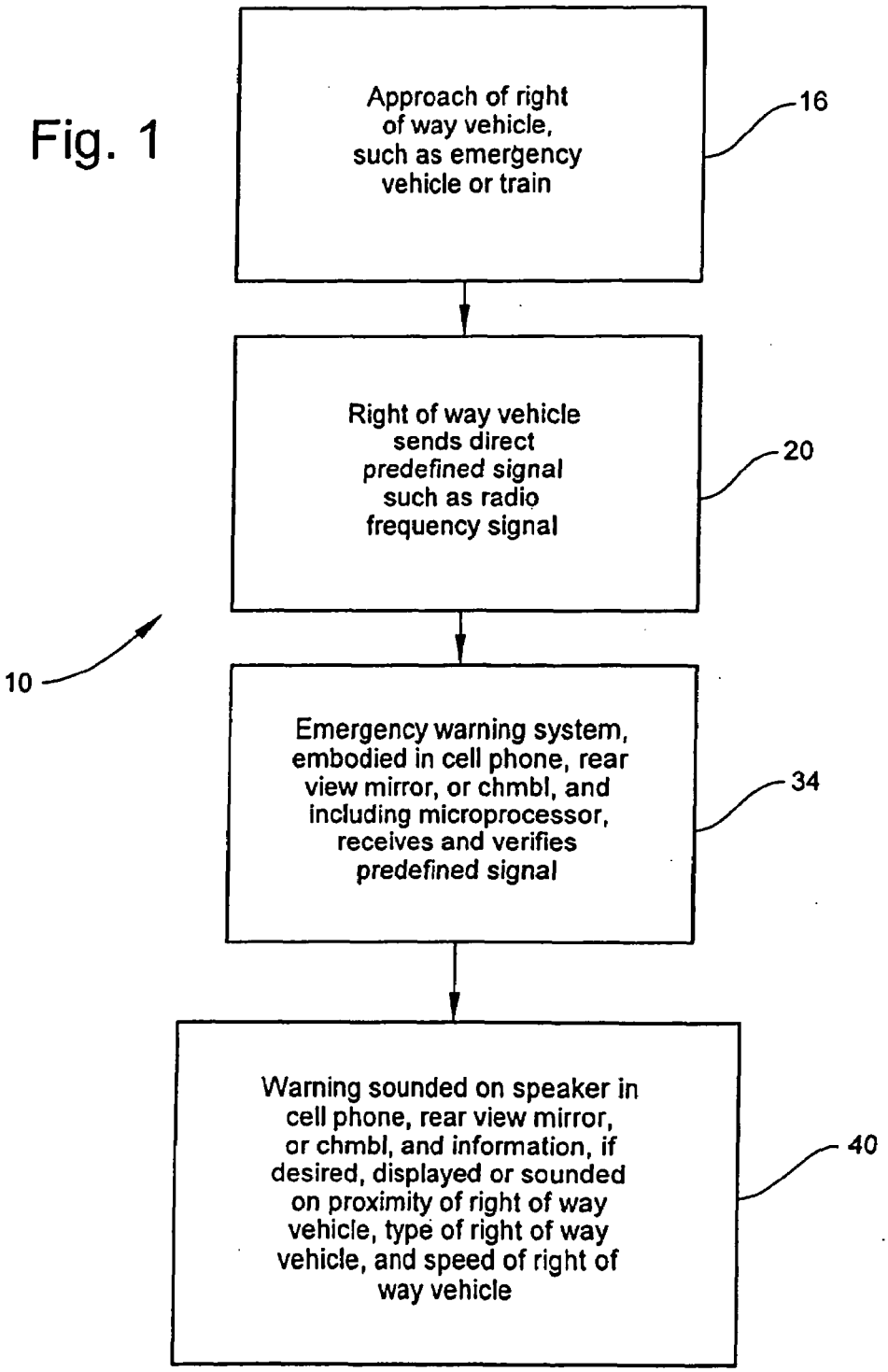
FIG. 1 is a flow chart showing the present method for directly communicating the right of way predefined signal to the present emergency warning system embodied in a cell phone, rear view mirror or CHMBL.
Figure 4A:
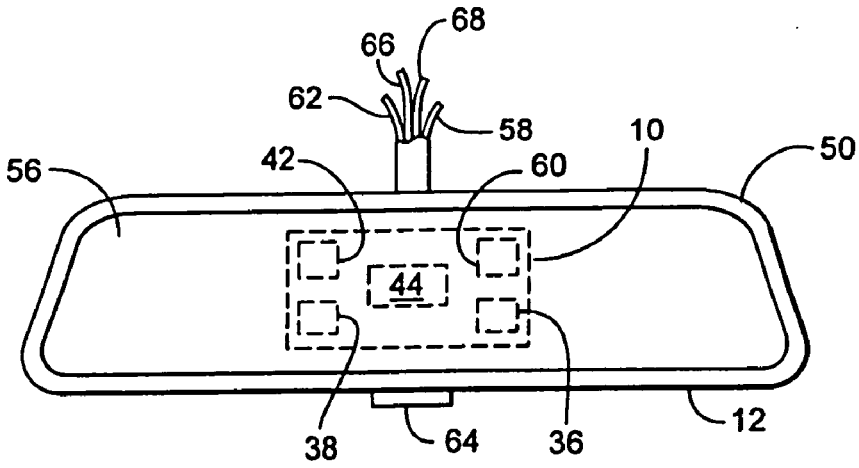
FIG. 4A is a front view of an automotive internal rear view mirror showing in phantom the present emergency warning system.
Figure 4B:
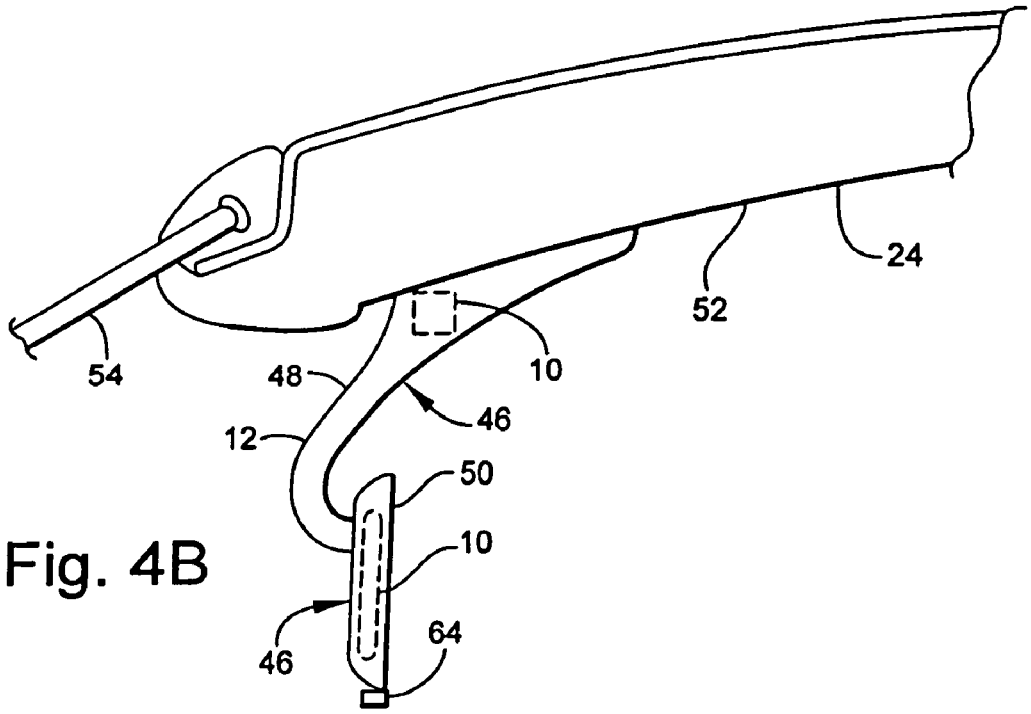
FIG. 4B is a side view of the automotive internal rear view mirror of FIG. 4A showing in phantom several locations for housing the present emergency warning system.
Figure 5:
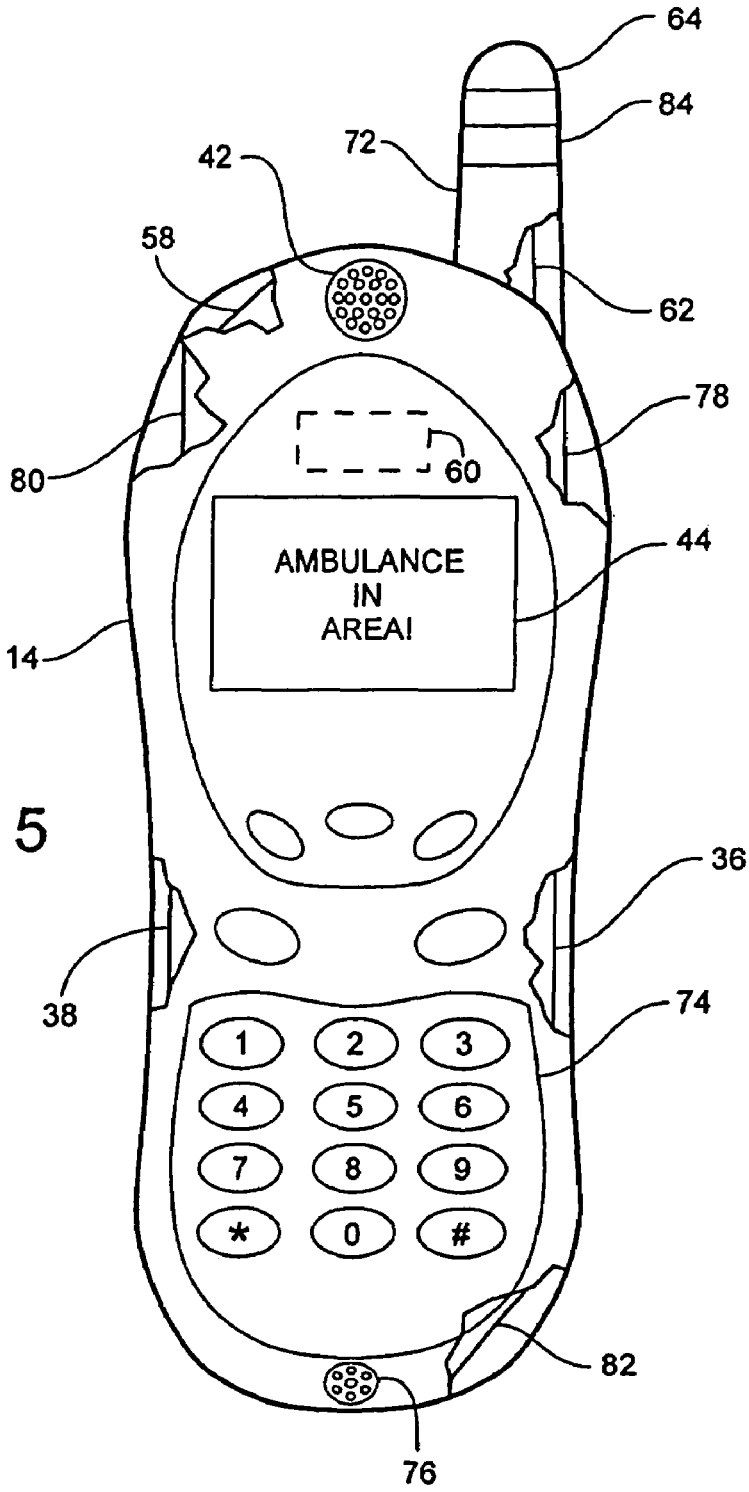
FIG. 5 is a front, partially cut away view of a cell phone housing the emergency warning system.
Figure 6:
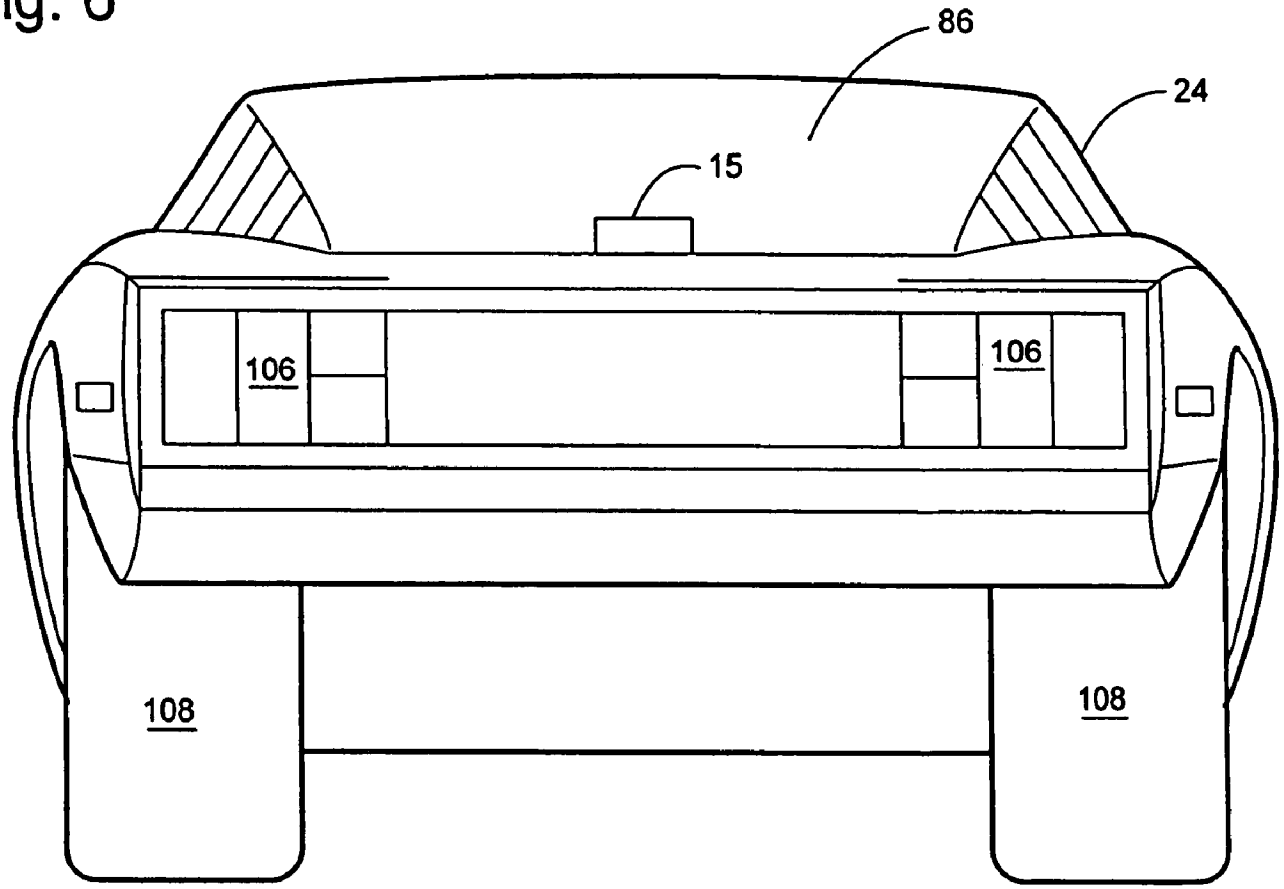
FIG. 6 is a rear view of a potentially blocking vehicle having a CHMBL with the present emergency warning system embodied therein.
Figure 7A:
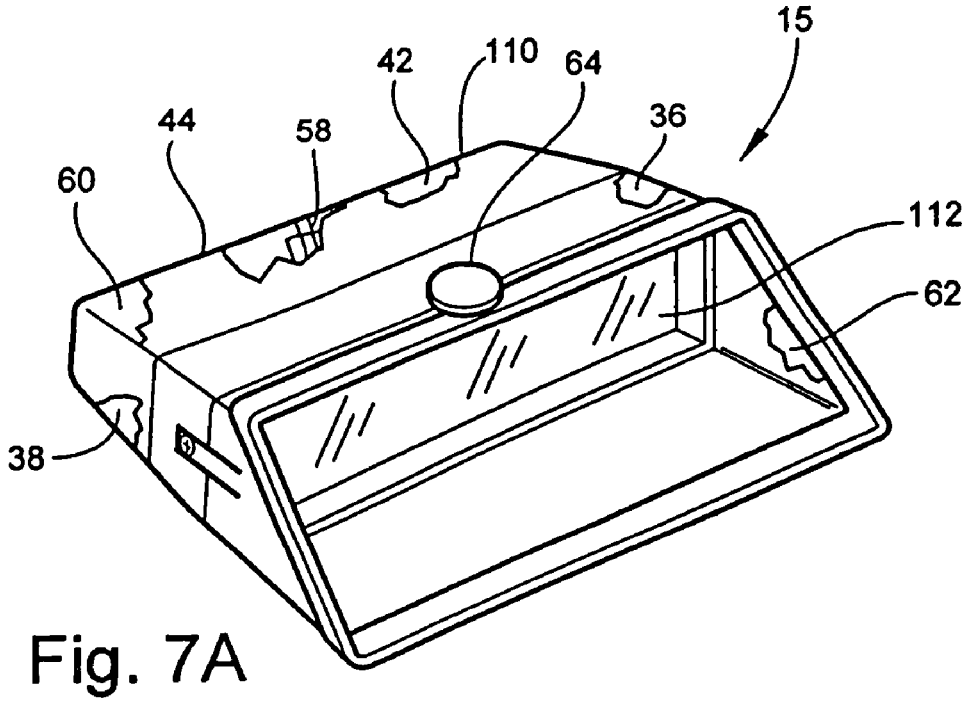
FIG. 7A is a perspective, partially cut away view of the CHMBL of FIG. 6.
Figure 7B:
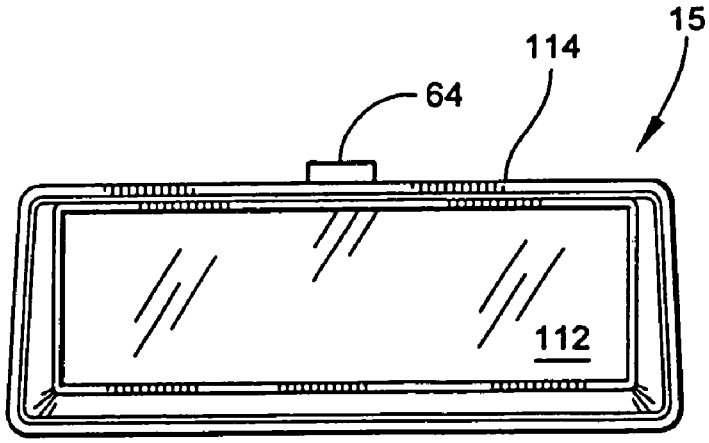
FIG. 7B is a front view of the CHMBL of FIG. 6.
Figure 9A:
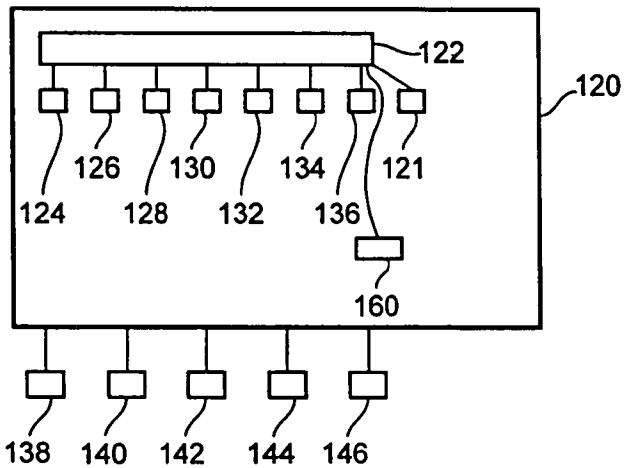
FIG. 9A is a diagrammatic view of a telematics unit or system that incorporates the present emergency warning system 10.

The present emergency warning system is indicated in general by the reference number 10 in FIG. 1. The emergency warning system 10 can be housed in an automotive rear view mirror 12, as shown in FIGS. 4A and 4B, or a cell phone 14 as shown in FIG. 5, or a CHMBL 15 as shown in FIGS. 6, 7A and 7B, or a telematics unit or system 120 as shown in FIG. 9A, or at least partially in a license plate 200 shown in FIG. 10A, or at least partially in a license plate holder 202 for a license plate 204 shown in FIG. 10B, or at least partially in a stand-alone housing 300 shown in FIG. 11.

Figure 2:
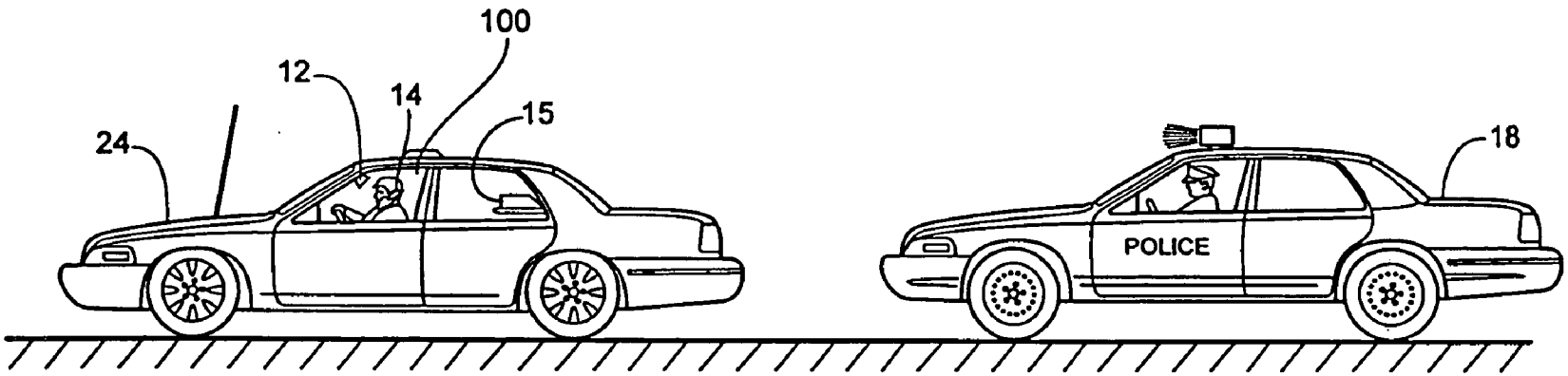
FIG. 2 is a diagrammatic view of a police car sending the right of way predefined signal to a potentially blocking vehicle having the present emergency warning system embodied in a cell phone, rear view mirror and CHMBL.

As shown in FIG. 1, the emergency warning system or method 10 includes the step 16 of warning of an approaching right of way vehicle 18, as shown in FIG. 2. The right of way vehicle 18 shown in FIG. 2 is a police car. The right of way vehicle 18 may be a police car, an ambulance, a fire engine, a train, or another vehicle traveling a relatively high speeds for the area in which it is traveling, such as an urban area or a rural area or another type of area.

Figure 8:
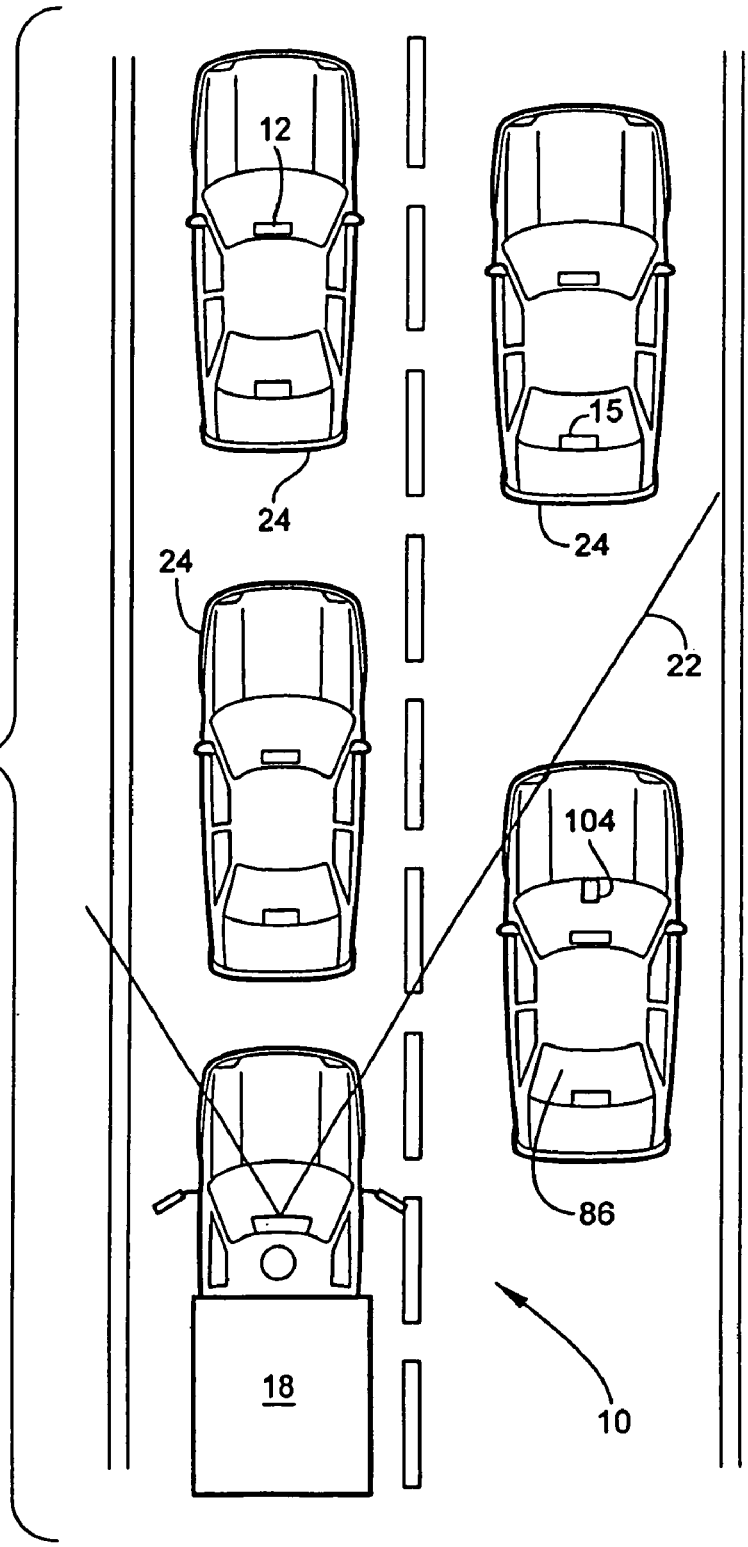
FIG. 8 is a diagrammatic view of a police car sending the right of way predefined signal to a set of potentially blocking vehicles and shows how the right of way predefined signal can be selectively transmitted, such as over a cone shaped forwardly extending area.

As shown in FIG. 1, the emergency warning system or method 10 includes the step 20 of sending a predefined signal that is a direct signal 22, as shown in FIG. 8. One type of direct signal 22 is a cone type of radio frequency (RF) signal. Such a cone signal may cover a relatively broad area or a relatively narrow area, depending upon the type of traffic situation or type of roadway that a right of way vehicle will encounter. Preferably the cone of the cone signal is relatively narrow so as to generate warnings in only those objects 12, 14, 15 that are found in potentially blocking vehicles 24 in the pathway of the right of way vehicle 12. A direct signal is not necessarily a cone signal. A direct signal is a signal that travels directly from the right of way vehicle 18 to the potentially blocking vehicle 24 without any aid from an outside or third party infrastructure such as a cell phone network. The direct signal can be one or more of 1) a strobe light signal, 2) a radio signal such as a digital radio signal, 3) a dedicated short-range communication signal, and 4) a wireless local area network signal. Any of such direct signals can carry information that is utilized by the emergency warning system 10, with such information being, for example, the presence of an emergency warning vehicle and the type of emergency warning vehicle.

As shown in FIG. 1, emergency warning method or system 10 includes a step 34 of receiving and verifying the direct predefined signal 22. The step of receiving the signal 22 is performed by receiver 36. Preferably, the receiver 36 of the emergency warning system 10 is always on. Receiver 36 can be powered by a stand alone single purpose dedicated battery 38, where the single purpose of battery 38 is to provide power to the hardware of the emergency warning system 10. The step of verifying verifies that signal 22 is from an authorized right of way vehicle. The step of verifying can include: 1) counting pulses where the signal is a direct light signal, 2) matching the signal 22 with stored information where the signal is digital radio signal, a dedicated short-range communication signal, or a wireless local area network signal, or 3) some other method where only authorized transmissions can be verified.

As shown in FIG. 1, emergency warning method or system 10 includes a step 40 of generating a warning. Preferably the step 40 of generating a warning includes the step of sounding a warning on a speaker 42. Step 40 may include the step of displaying a warning such as on a display 44. Step 40 may include the step of generating a warning such as initiating a vibration of cell phone 14.

Step 40 of generating a warning can also include the step of sounding or displaying information carried by signal 22. Such information to be sounded or displayed can include information on one or more of the proximity of the right of way vehicle, the type of right of way vehicle, and the speed of the right of way vehicle. Examples of warnings are voice warnings, siren warnings, and blinking red lights.

The Automotive Rear View Mirror 12 Having the Emergency Warning System 10

Figure 3:
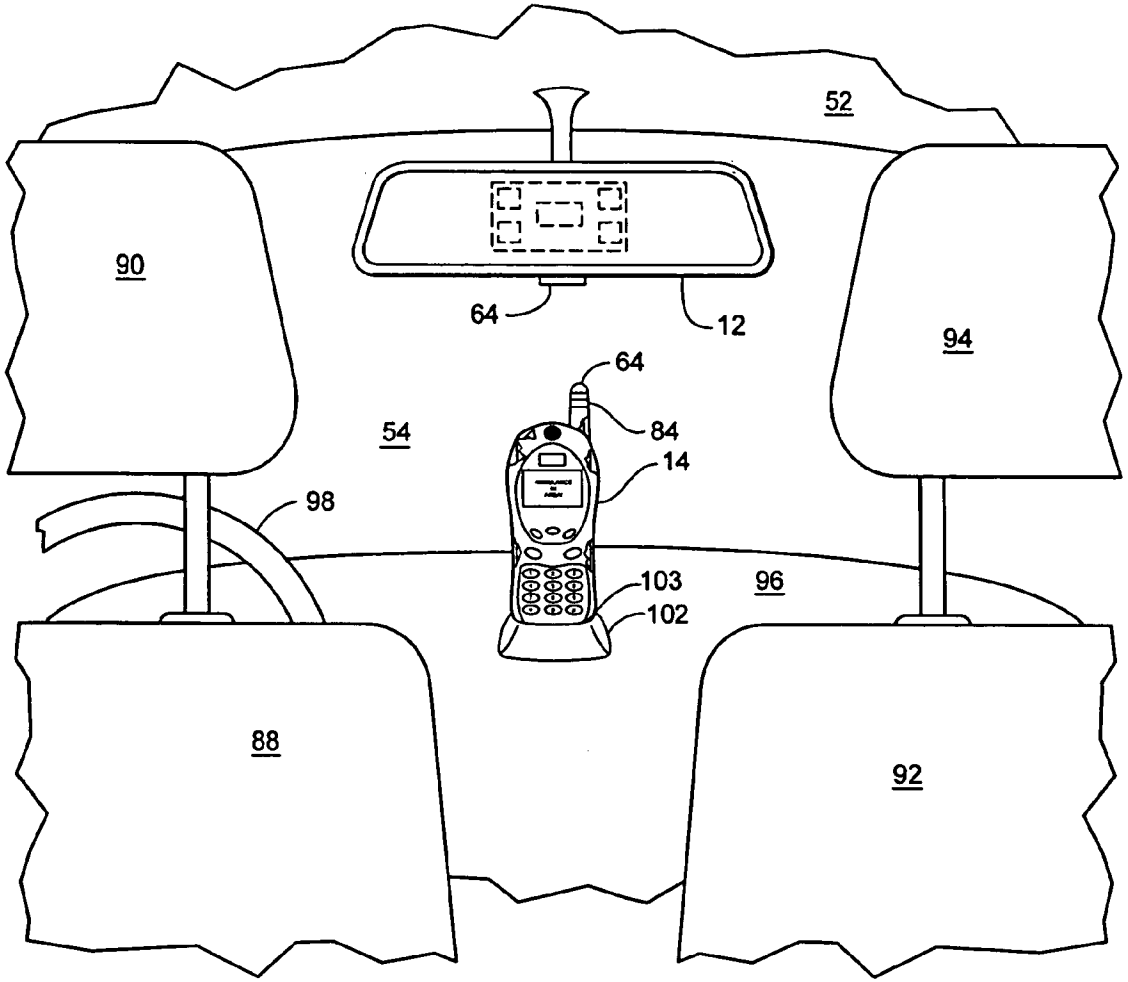
FIG. 3 is a diagrammatic view from directly behind the front seats of the potentially blocking vehicle and shows how a cell phone and rear view mirror, that embody the present emergency warning system, can be centrally mounted within the potentially blocking vehicle to maximize exposure for pick up of the right of way predefined signal which, most of the time, will come from behind the potentially blocking vehicle.

The automotive rear view mirror 12 is shown in FIGS. 3, 4A and 4B. FIG. 3 shows that the rear view mirror 12 is a type of object that is situated at a location in the potentially blocking vehicle 24 that maximizes exposure of a photosensitive cell 64 to a predefined right of way light signal from the right of way vehicle 18. Such a location is generally central (generally on a central longitudinally extending axis extending forwardly and rearwardly). Such a location is further at a height below the upper edge of the front and rear windshields 54, 86. Such a location is further at a height above the lower edge of the front and rear windshields 54, 86. Such a location is further at a height below the upper edge of side windows 100, as shown in FIG. 2. Such a location is further at a height above the upper edge of side windows 100. In other words, photosensitive cell 64 is oriented such that a line, parallel to the ground, can extend from the photosensitive cell 64 and to and through any of the windows of the potentially blocking vehicle 24 with minimal obstruction. FIG. 3 further shows a driver seat 88, a driver headrest 90, a passenger seat 92, a passenger headrest 94, a dashboard 96, and a steering wheel 98. An omni-directional photosensitive cell 64, as shown in FIGS. 3 and 4A, is engaged to a lower surface of housing 46 and is disk shaped, with photosensitive cell receptors extending for 360 degrees about an annular side of photosensitive cell 64, such that photosensitive cell 64 can pick up the right of way predefined light signal from a maximum number of directions.

As shown in FIG. 4A, mirror 12 includes a housing 46 for engaging a mirror or reflective element 48. Housing 46 includes a first housing portion 48 formed in the nature of a support arm and a second housing portion 50. The first housing portion or support arm 48 supports the second housing portion 50 relative to a ceiling 52 of a potentially blocking vehicle 24 where a distal end portion of the support arm 48 engages the ceiling 52. If desired the distal end of the support arm 48 can engage the inner surface of a windshield 54 of the potentially blocking vehicle 24. The second housing portion 50 engages a mirror or reflective element 56. Hardware for the emergency warning system 10 can be engaged or housed in the first housing portion (support arm 48), as shown in phantom in FIG. 3B. Hardware for the emergency warning system 10 can be engaged or housed in the second housing portion 50. Or hardware for the emergency warning system 10 can be engaged or housed in another portion of the mirror 12. Or a portion of the hardware for the emergency warning system 10 can be engaged in the support arm 48 and another portion of the hardware for the emergency warning system 10 can be engaged in the second housing portion 50. Or a portion of the hardware for the emergency warning system 10 can be engaged or housed elsewhere in the potentially blocking vehicle 24. However, it is preferable that the emergency warning system 10 is wholly contained in the structure of the internal rear view mirror 12 itself such that the emergency warning system 10 is operable even before the internal rear view mirror 12 is engaged to ceiling 52 or windshield 54.

The internal rear view mirror 12 includes a) housing 46 having first housing portion 48 and second housing portion 50, b) mirror or reflective element 56 in the housing 46, c) an electrical (perhaps wireless) circuit 58 in the housing 46, d) a processor or microprocessor 60 in the housing 46 and in communication with the circuit 58, e) an antenna 62 engaged to the housing 46 and being in communication with the circuit 58, f) the speaker 42 engaged to the housing 46 and being in communication with the circuit 58, g) the battery 38 engaged to the housing 46 and being in communication with the circuit 58, h) a disk shaped photosensitive cell 64 engaged to the underside of the housing 46 and being in communication with the circuit 58, i) the emergency warning receiver 36 engaged to the housing 46 and being in communication with the circuit 58, and j) instructions for carrying out the emergency warning system or method 10 in the processor or microprocessor 60. It should be noted that the processor or microprocessor 60 may be a computer chip physically housed, for example, with the receiver 36. It should be noted that, to extend the battery life of battery 38, power lines 66, 68 may run to the car battery of the potentially blocking vehicle 24. If desired, the internal rear view mirror 12 can further include the display 44 engaged to the housing 46 and being in communication with the circuit 58. As to an internal rear view mirror having a display, the Mousseau U.S. Pat. No. 6,520,667 B1 issued Feb. 18, 2003 and entitled Vehicle Interior Rearview Mirror Assembly with Display is hereby incorporated by reference in its entirety.

The Cell Phone 14 Having the Emergency Warning System 10

The cell phone 14 is shown in FIGS. 3 and 5. As shown in FIG. 3, cell phone 14 may be mounted, when in use or when not in use, in a holder 102 engaged to the dashboard 96. Holder 102 contains a receptacle 103 customized to a particular cell phone 14 such that the cell phone 14 can stand upright or in another manner where photosensitive cell 64 can pick up the predefined right of way light signal that is picked up by the photosensitive cell 64 of the rear view mirror 12. In other words, when cell phone 14 is located according to the present invention, photosensitive cells 64 and 84 are oriented such that a line, parallel to the ground, can extend from the photosensitive cell 64 or 84 and to and through any of the windows of the potentially blocking vehicle 24 with minimal obstruction. Such an orientation is on the central longitudinally extending axis of the potentially blocking vehicle 24 and between the lower and upper edges of the front, rear and side windows of the potentially blocking vehicle 24.

Or a quick connect and quick disconnect holder 104, as shown in FIG. 8, can engaged the cell phone to the front windshield 54. One quick connect and quick disconnect holder 104 is a strip of a hook and loop connector material (such as Velcro®) engaged to the front windshield and a cooperating strip of a hook and loop connector material (such as Velcro®) engaged to the rear face of the cell phone 14. As with holder 102, holder 104 mounts the cell phone 14 such that photosensitive cells 64 and 84 are oriented such that a line, parallel to the ground, can extend from the photosensitive cell 64 or 84 and to and through any of the windows of the potentially blocking vehicle 24 with minimal obstruction. Such an orientation is on the central longitudinally extending axis of the potentially blocking vehicle 24 and between the lower and upper edges of the front, rear and side windows of the potentially blocking vehicle 24.

Another quick connect and quick disconnect holder 104 for the front windshield 54 is an apparatus utilizing suction cups. Such apparatus is conventionally utilized for radar detectors. However, such apparatus can be utilized for the present cell phone 14 in the stead of the radar apparatus. As to such suction cup apparatus, the following U.S. Patents are hereby incorporated by reference in their entireties: 1) the Sokol U.S. Pat. No. 4,648,572 issued Mar. 10, 1987 and entitled Bracket For Supporting A Radar Detector Or Like Device, 2) the Sokol U.S. Pat. No. 4,836,482 issued Jun. 6, 1989 and entitled Hinged Support Bracket For A Radar Detector Or Like Device, and 3) the Zheng et al. U.S. Pat. No. 6,779,765 B2 issued Aug. 24, 2004 and entitled Mounting Device For A Radar Detector. When the cell phone 14 instead of the radar detector is engaged in such apparatus, it is preferred that the cell phone 14 lie in a position generally parallel to the ground or dashboard where such a position maximizes view for the driver out of the windshield 54 and minimizes any obstructing view for the driver. The cell phone 14 may lie in a perpendicular position relative to the ground if such a position does not result in obstructing the view for the driver.

As shown in FIG. 5, cell phone 14 includes a) a housing 70, b) the electrical (perhaps wireless) circuit 58 in the housing 70, c) the processor or microprocessor 60 in the housing 70 and in communication with the circuit 58, d) a cell phone antenna 72 engaged to the housing 70, e) the display 44 engaged to the housing 70 and being in communication with the circuit 58, f) a keyboard 74 engaged to the housing 70 and being in communication with the circuit 58, g) a microphone 76 engaged to the housing 70 and being in communication with the circuit 58, h) the speaker 42 engaged to the housing 70 and being in communication with the circuit 58, i) a cell phone receptor 78 engaged to the housing 70 and being in communication with the cell phone antenna 72, with the cell phone receptor 78 being responsive to a cell phone signal, j) a cell phone transmitter 80 for sending a cell phone signal, with the cell phone transmitter 80 engaged in the housing 70 and being in communication with the cell phone antenna 72, k) the emergency warning receiver 36 engaged to the housing 70 and being in communication with the circuit 58 where a cell phone receptor 78 is provided separately from an emergency warning receiver 36, l) the emergency warning system battery 38 engaged to the housing 70 and being in communication with the circuit 58, m) a cell phone battery 82 engaged to the housing 70 and being in communication with the circuit 58, n) the emergency warning system antenna 62 engaged to the housing 70 where a separate cell phone antenna 72 and a separate emergency warning antenna 62 are provided, o) the photosensitive cell 64 engaged to the housing 70 via the cell phone antenna 72 and being formed at the tip of the antenna 72 (or alternately in an endless strip form as shown by reference number 84) with the photosensitive cell 64 or 84 being in communication with the circuit 58, p) and instructions for carrying out the emergency warning system or method 10 in the processor or microprocessor 60. As to a cell phone, the following U.S. Patent Numbers are hereby incorporated by reference in their entireties: a) the Masamura U.S. Pat. No. 6,819,939 issued Nov. 16, 2004 and entitled Cellular Phone With High-Quality Sound Reproduction Capability, and b) the Kobayashi U.S. Pat. No. 6,823,198 issued Nov. 23, 2004 and entitled Portable Phone With Camera.

It should be noted that the emergency warning system 10 can include, and cell phone 14 can include, either or both of, a) the cell phone receptor 78 and b) the emergency warning system receiver 38, such that either or both of the cell phone receptor 78 and emergency warning system receiver 38 can be in communication with the emergency warning system 10.

It should be noted that the emergency warning system 10 can make use of either of both of, and cell phone 14 can include either or both of, a) the emergency warning system antenna 62 and b) the cell phone antenna 72, such that either or both of the antennas 62, 72 can be in communication with the emergency warning system 10.

It should be noted that the battery 38 of the emergency warning system can be recharged at the same time that the battery 82 for the cell phone 14 is recharged.

The present cell phone includes a) a housing; b) an electrical circuit in the housing; c) a processor in the housing and being in communication with the circuit; d) a cell phone antenna engaged to the housing; e) a display engaged to the housing and being in communication with the circuit; f) a keyboard engaged to the housing and being in communication with the circuit; g) a microphone engaged to the housing and being in communication with the circuit; h) at least one speaker engaged to the housing and being in communication with the circuit; i) a cell phone receptor responsive to a cell phone signal and being in communication with the circuit and the cell phone antenna; j) a cell phone transmitter for sending a cell phone signal and being in communication with the circuit and the cell phone antenna; k) at least a first battery engaged to the housing and being in communication with the circuit; and l) an emergency warning system for picking up a right of way vehicle predefined signal, with the emergency warning system engaged to the housing and being in communication with the circuit, with the emergency warning system optionally comprising an emergency warning system receiver and further optionally comprising an emergency warning system antenna in communication with the emergency warning system receiver, with at least one of the cell phone receptor and emergency warning system receiver being responsive to said right of way vehicle predefined signal, and with the emergency warning system emitting, when said right of way vehicle predefined signal has been picked up, at least one of an audio warning via said speaker and a visible warning via said display.

The present invention includes a cell phone wherein the emergency warning system thereof includes the emergency warning system receiver and further includes the emergency warning system antenna, with the emergency warning system receiver being in communication with the emergency warning system antenna, with the emergency warning system receiver being responsive to said right of way vehicle predefined signal.

The present invention includes a cell phone wherein the emergency warning system thereof includes a receiver responsive to a direct right of way vehicle predefined signal.

The present invention includes a cell phone wherein the emergency warning system thereof includes a radio frequency (RF) receiver responsive to said right of way vehicle predefined signal.

The present invention includes a cell phone wherein the emergency warning system thereof includes at least one of a 2.4 and 5.9 GHz receiver responsive to said right of way vehicle predefined signal.

The present invention includes a cell phone wherein the emergency warning system thereof includes a digital radio receiver responsive to said right of way vehicle predefined signal.

The present invention includes a cell phone wherein the emergency warning system thereof includes an IEEE 802.11 network receiver responsive to said right of way vehicle predefined signal, where IEEE stands for Institute of Electrical and Electronics Engineers.

The present invention includes a cell phone wherein the emergency warning system thereof includes a wireless local area network receiver responsive to said right of way vehicle predefined signal.

The present invention includes a cell phone wherein the emergency warning system thereof is responsive to a right of way vehicle predefined signal that includes information on a distance between the cell phone and a source of the right of way vehicle predefined signal, and with at least one of said display and speaker emitting said information.

The present invention includes a cell phone wherein the emergency warning system thereof is responsive to a right of way vehicle predefined signal that includes information on a type of right of way vehicle emitting said right of way vehicle predefined signal, and with at least one of said display and speaker emitting said information.

The present invention includes a cell phone wherein the emergency warning system thereof is responsive to a right of way vehicle predefined signal that includes information on a speed of a source of the right of way vehicle predefined signal, and with at least one of said display and speaker emitting said information.

The present invention includes a cell phone wherein the emergency warning system thereof is responsive to a right of way vehicle predefined signal that includes information on an absolute location of a source of the right of way vehicle predefined signal, and with at least one of said display and speaker emitting said information.

The present invention includes a cell phone wherein the emergency warning system thereof includes a second battery engaged with the emergency warning system such that the emergency warning system is always on even when the first battery is powered off such that said audio warning, initiated by reception of said right of way vehicle predefined signal, can be emitted even when the first battery is powered off.

The CHMBL 15 Having the Emergency Warning System 10

CHMBL (center high mounted brake light) 15 is shown in FIGS. 6, 7A and 7B. FIG. 6 shows the rear end of a potentially blocking vehicle 24 and further shows the rear windshield 86. Many CHMBLs 15 are mounted in the interiors of their respective vehicles immediately inwardly of the rear windshield 86 along a lower edge portion of the rear windshield 86. Potentially blocking vehicle 24 includes a pair of lower rear brake lights 106, and rear tires 108. CHMBL 15 is mounted at an elevation higher than the elevation of the lower rear brake lights 106 and is on a central, longitudinally extending (forwardly and rearwardly extending) axis of the vehicle 24.

As shown in FIG. 7A, CHMBL 15 includes a housing 110 for housing a brake light and a red translucent light dispersing piece of plastic 112, which is the "red light" seen by a motorist trailing the CHMBL 15. Housing 110 can be mounted in the rear window area of a vehicle 24 by screws, clamps, or quick connect and quick disconnect fabric having hooks and loops (such as Velcro®) or by other connectors. Housing 110 includes the photosensitive cell 64 mounted on an upper face 114 of housing 110. Photosensitive cell 64 of CHMBL 15 is disk shaped and includes photosensitive receptors on its endless annular side such that the photosensitive cell 64 is an omni-directional sensor (for 360 degrees, like photosensitive cell 64 of rear view mirror 12).

Hardware for the emergency warning system 10 can be engaged or housed in the housing 110, as shown in FIG. 7A. Or a portion of the hardware for the emergency warning system 10 can be engaged or housed elsewhere in the potentially blocking vehicle 24. However, it is preferable that the emergency warning system 10 is wholly contained in the structure of the CHMBL 15 itself such that the emergency warning system 10 is operable even before the CHMBL 15 is engaged to vehicle 24 at the rear windshield 86.

The CHMBL 15 includes a) housing 110, b) a brake light in the housing 110 and the red plastic piece 112 that disperses the light when the brake light is turned on, c) an electrical (perhaps wireless) circuit 58 in the housing 110, d) a processor or microprocessor 60 in the housing 110 and in communication with the circuit 58, e) an antenna 62 engaged to the housing 110 and being in communication with the circuit 58, f) a speaker 42 engaged to the housing 110 and being in communication with the circuit 58, g) a battery 38 engaged to the housing 110 and being in communication with the circuit 58, h) a photosensitive cell 64 engaged to the housing 110 and being in communication with the circuit 58, i) an emergency warning receiver 36 engaged to the housing 110 and being in communication with the circuit 58, and j) instructions for carrying out the emergency warning system or method 10 in the processor or microprocessor 60. It should be noted that the processor or microprocessor 60 may be a computer chip physically housed, for example, with the receiver 36. It should be noted that, to extend the battery life of battery 38, electrical lines may run to the car battery of the potentially blocking vehicle 24. If desired, the CHMBL 15 can further include a display 44 engaged to the forwardly facing face of the housing 110 and being in communication with the circuit 58. As to CHMBL 15, the following U.S. Patent Numbers are hereby incorporated by reference in their entireties: 1) the Shy U.S. Pat. No. 5,550,718 issued Aug. 27, 1996 and entitled Third Brake Light For Automobiles, 2) the Wang U.S. Pat. No. 5,111,183 issued May 5, 1992 and entitled Third Brake Lamp Employing Optical Fibers, 3) the Chou U.S. Pat. No. 5,631,627 issued May 20, 1997 and entitled Control Circuit For Center High Mounted Brake Lights, and 4) the Fox U.S. Pat. No. 6,799,873 B2 issued Oct. 5, 2004 and entitled Multifunctional Third Brake Light.

It should be noted that a third brake light 15 or auxiliary brake light 15 may not necessarily be centered (i.e., on a longitudinal axis of the vehicle) and may not be even in a general center area, while by its nomenclature, a CHMBL is centered. For example, a third brake light 15 or auxiliary brake light 15 may be at a right or left portion of the rear windshield 86.

The present invention includes a third brake light that includes: a) a housing adaptable for engagement in an automobile; b) a light in the housing for lighting up a red plastic piece engaged on the housing when brakes are applied; c) an electrical circuit in the housing; d) a processor in the housing and being in communication with the circuit; e) an antenna engaged to the housing; f) at least one of a speaker and display engaged to the housing and being in communication with the circuit; g) a battery engaged to the housing and being in communication with the circuit; and h) an emergency warning system for picking up a right of way vehicle predefined signal, with the emergency warning system engaged to the housing and being in communication with the circuit, with the emergency warning system comprising a receiver responsive to said right of way vehicle predefined signal and being in communication with the antenna, and with the emergency warning system emitting, when said right of way vehicle predefined signal has been picked up, at least one of an audio warning via said speaker and a visible warning via said display.

The present invention includes a third brake light wherein the emergency warning system thereof includes a receiver responsive to a direct right of way vehicle predefined signal.

The present invention includes a third brake light wherein the emergency warning system thereof includes a radio frequency (RF) receiver responsive to said right of way vehicle predefined signal.

The present invention includes a third brake light wherein the emergency warning system thereof includes at least one of a 2.4 and 5.9 GHz receiver responsive to said right of way vehicle predefined signal.

The present invention includes a third brake light wherein the emergency warning system thereof includes a digital radio receiver responsive to said right of way vehicle predefined signal.

The present invention includes a third brake light wherein the emergency warning system thereof includes an IEEE 802.11 network receiver responsive to said right of way vehicle predefined signal, where IEEE stands for Institute of Electrical and Electronics Engineers.

The present invention includes a third brake light wherein the emergency warning system thereof includes a wireless local area network receiver responsive to said right of way vehicle predefined signal.

The present invention includes a third brake light wherein the emergency warning system thereof is responsive to a right of way vehicle predefined signal that includes information on a distance between the center high mounted brake light and a source of the right of way vehicle predefined signal, and with at least one of said display and speaker emitting said information.

The present invention includes a third brake light wherein the emergency warning system thereof is responsive to a right of way vehicle predefined signal that includes information on a type of right of way vehicle emitting said right of way vehicle predefined signal, and with at least one of said display and speaker emitting said information.

The present invention includes a third brake light wherein the emergency warning system thereof is responsive to an right of way vehicle predefined signal that includes information on a speed of a source of the right of way vehicle predefined signal, and with at least one of said display and speaker emitting said information.

The present invention includes a third brake light wherein the emergency warning system thereof is responsive to an right of way vehicle predefined signal that includes information on an absolute location of a source of the right of way vehicle predefined signal, and with at least one of said display and speaker emitting said information.

The present invention includes a third brake light wherein the emergency warning system thereof includes a second battery engaged with the emergency warning system such that the emergency warning system is always on even when the first battery is powered off such that said audio warning, initiated by reception of said right of way vehicle predefined signal, can be emitted even when the first battery is powered off.

The present invention includes a third brake light wherein the emergency warning system thereof is mounted in a center high mounted brake light.

Direct Right of Way Predefined Signal

A direct right of way predefined signal is a signal such as a light signal or strobe light signal. As to generating, receiving and utilizing a strobe light signal or other types of signals, the following U.S. Patents are hereby incorporated by reference in their entireties: 1) the McKenna U.S. Pat. No. 5,495,243 issued Feb. 27, 1996 and entitled Emergency Vehicle Alarm System For Vehicles, 2) the Henry et al. U.S. Pat. No. 6,094,148 issued Jul. 25, 2000 and entitled Vehicular Emergency Vehicle Alarm Apparatus, 3) the Hamer U.S. Pat. No. 5,187,476 issued Feb. 16, 1993 and entitled Optical Traffic Preemption Detector Circuitry, 4) the Hamer et al. U.S. Pat. No. 5,202,683 issued Apr. 13, 1993 and entitled Optical Traffic Preemption Detector, and 5) the Haagenstad et al. U.S. Pat. No. 5,602,739 issued Feb. 11, 1997 and entitled Vehicle Tracking System Incorporating Traffic Signal Preemption. A receiver, such as photosensitive or photo cell 64 is shown in FIG. 4A engaged on the underside of the rear view mirror 12 such that the photosensitive cell 64 is displayed prominently and clear of obstructions for a clean path for detection of a strobe light generated from behind the vehicle 24 having the internal rear view mirror 12 (or generated from a 360 degree circle about vehicle 24). The cell phone 14 can also have such a receiver or photosensitive cell 64. Such a photosensitive cell 64 is preferably located in a spherical or hemispherical form such as on the tip of an antenna 62 such that the photosensitive cell 64 picks up a strobe light regardless of the orientation of the cell phone 14 and regardless of whether the cell phone 14 is being held in the right or left ear. If desired, the photosensitive cell can be manufactured in a strip form 84, as shown in FIG. 4, where the strip form 84 winds endlessly and for 360 degrees about the antenna 62. The CHMBL 15 can also have such a photosensitive or photo cell 64.

Another direct right of way predefined signal is a signal such as a radio frequency signal. As to an emergency warning system, including the steps of transmitting and receiving a radio frequency signal, the following U.S. Patents are hereby incorporated by reference in their entireties: 1) the McKenna U.S. Pat. No. 6,252,519 issued Jun. 26, 2001 and entitled Emergency Vehicle Signaling System, and 2) the Hall et al. U.S. Pat. No. 5,539,398 issued Jul. 23, 1996 and entitled GPS-Based Traffic Control Preemption System. The radio frequency signal may be generated and received at or about at least one of 2.4 and 5.9 GHz.

Another direct right of way predefined signal is a dedicated (or directed) short-range communication (DSRC) signal generated by a DSRC apparatus and received by a DSRC apparatus incorporated into the emergency warning system 10. As to a DSRC apparatus or system, the Inoue U.S. Pat. No. 6,300,882 B1 issued Oct. 9, 2001 and entitled Vehicle-Onboard DSRC Apparatus is hereby incorporated by reference in its entirety. The DSRC signal may be generated and received at or about at least one of 2.4 and 5.9 GHz.

Another direct right of way predefined signal is a wireless local area network signal generated by a wireless local area network apparatus and received by a wireless local area network apparatus incorporated into the emergency warning system 10. As to a wireless local area network apparatus or system, the Budin et al. U.S. Pat. No. 5,276,703 issued Jan. 4, 1994 and entitled Wireless Local Area Network Communications System is hereby incorporated by reference in its entirety. The wireless local area network signal may be generated and received at or about at least one of 2.4 and 5.9 GHz. One local area network system is the IEEE 802.11 (or IEEE 802.11A) system where IEEE stands for Institute of Electrical and Electronics Engineers. Another local area network system is Motorola's control channel based Freespace system. The wireless local area network signal may be generated and received at or about at least one of 2.4 and 5.9 GHz.

Another direct right of way predefined signal is a digital radio signal generated by a digital radio apparatus and received by a digital radio apparatus incorporated into the emergency warning system 10. As to a digital radio apparatus or system, the Davis et al. U.S. Pat. No. 6,804,525 B2 issued Oct. 12, 2004 and entitled Method And Apparatus For Facilitating Two-Way Communications Between Vehicles is hereby incorporated by reference in its entirety. The digital radio signal may be generated and received at or about at least one of 2.4 and 5.9 GHz.

Another direct right of way predefined signal is an infrared signal, such as one centered at about 0.950 micrometers and modulated with a 40 KHz carrier. Such an infrared signal can be received by an infrared receiver that includes a photovoltaic detector in parallel with a tunable inductor. As to such, the Smith U.S. Pat. No. 4,704,610 issued Nov. 3, 1987 and entitled Emergency Vehicle Warning And Traffic Control System is hereby incorporated by reference in its entirety.

Power Always On

Preferably, the emergency warning system or method 10 includes the step of providing a dedicated battery 38 such that the emergency warning system or method 10 is always on. If desired, the emergency warning system or method 10 can draw power from cell phone battery 82 or from the automotive battery for vehicle 24 via power lines 66, 68.

It should be noted that rear view mirror apparatus 12, chmbl apparatus 15, telematics unit 120, license plate apparatus 200, license plate apparatus 204, and housing 300 can be provided with or without a dedicated battery or other power source. If without a dedicated battery, such apparatus 12, 15, 120, 200 and 204 are hard-wired to the battery or other power source of the vehicle having such apparatus.

With or without a dedicated battery, such apparatus 12, 15, 120, 200, 204 and 300 can be in an always on state, such as by drawing an extremely minimal amount of current from the battery of the vehicle.

A Tamper Proof Emergency Warning System 10

Numerous methods exist for making the emergency warning system 10 tamper proof as, for example: 1) the dedicated battery 38 can be provided in the object housing the emergency warning system 10 such that it is moot whether or not the primary power source for the object, such as the first battery 82 in the cell phone 14 or the electrical connections 66, 68 to a car battery for the automotive internal rear view mirror 12, is providing power to the emergency warning system 10; 2) the dedicated battery 38 in the object housing the emergency warning system 10 can be disguised such that the man on the street cannot find such dedicated battery 38; 3) the dedicated battery 38 in the object housing the emergency warning system 10 can be so tiny that is difficult to locate; and/or 4) the emergency warning system 10 itself, including the dedicated battery 38, can be molded into the object such that only by destroying the object can the emergency warning system 10 be disabled.

The Step of Providing Feedback from the Potentially Blocking Vehicle to the Right of Way Vehicle 18

The emergency warning system or method 10 can include the step of providing feedback from the potentially blocking vehicle to the right of way vehicle 18. This step of providing feedback can include the step of providing a dedicated transmitter to the emergency warning method or system 10. Such a feedback signal can be an automatic feedback signal where the driver or passenger of the potentially blocking vehicle 24 performs no act and the emergency warning system or method 10 generates the feedback signal automatically. As to an automatic feedback signal, the following U.S. Patents are hereby incorporated by reference in their entireties: a) the McKenna U.S. Pat. No. 5,495,243 issued Feb. 27, 1996 and entitled Emergency Vehicle Alarm System For Vehicles, and b) the McKenna U.S. Pat. No. 6,252,519 issued Jun. 26, 2001 and entitled Emergency Vehicle Signaling System.

Operation

As a right of way vehicle 18, such as an ambulance or train, is making its way down the road or along the tracks, the right of way vehicle 18 issues the direct predefined signal 22. The signal 22 can carry information such as the type of right of way vehicle, the proximity of the right of way vehicle 18 relative to the potentially blocking vehicle 24, the speed of the right of way vehicle 18, as well as other information. An object housing the emergency warning system or method 10, such as the rear view mirror 12, or cell phone 14, or CHMBL 15, picks up the signal 22, verifies the signal 22 has originated from an authentic source, and generates a warning. Preferably the warning is an audio warning on speaker 42. If desired, the warning can be a visual warning on display 44 or each of an audio and visual warning at the same time. It is then hoped that the driver of the potentially blocking vehicle 24 steers out of the way and stops.

Indirect Right of Way Predefined Signal

The emergency warning system or method 10 can include the step of sending an indirect signal from a right of way vehicle 18 to a potentially blocking vehicle 24. One type of indirect signal 28 is a cellular phone call signal that utilizes a cell network to send the indirect signal ultimately to one potentially blocking vehicle 24.

It should be noted that the right of way vehicle 18 can issue at the same time the direct predefined signal 22 at the same time as the indirect predefined signal. Or the right of way vehicle 18 can issue the direct predefined signal 22 and the indirect predefined signal at selected times, such as at different times, or can utilize one signal when the other type of signal is not being recognized by a driver of a potentially blocking vehicle 24.

An indirect right of way predefined signal is a signal that utilizes outside or third party infrastructure to send a signal from a right of way vehicle 18 to a potentially blocking vehicle 24. For example, one indirect signal is a cell phone signal transmitted from the right of way vehicle 18 to a cell and then to another cell and then to a cell phone 14 carried by a driver or passenger in a potentially blocking vehicle 24. As to an indirect predefined signal, the Yates U.S. Pat. No. 6,845,316 issued Jan. 18, 2005 and entitled Distribution Of Traffic And Transit Information is hereby incorporated by reference in its entirety.

The Emergency Warning System 10 Incorporated into a Telematics Unit or System The present emergency warning system 10 can be incorporated into a telematics system. Telematics is, generally, the use of computers in concert with telecommunications systems. Telematics is almost synonymous with automotive telematics, i.e., the use of computers and telecommunications to enhance the functionality of motor vehicles, for example, wireless data applications in cars, trucks, and buses. Automotive telematics has also been generally described as the integration of wireless communications, vehicle monitoring systems and location devices. One example of a telematics system is the General Motors ONSTAR® system. As to automotive telematics systems, the following U.S. Patents are hereby incorporated by reference in their entireties: 1) the Kacel U.S. Pat. No. 6,687,587 B2 issued Feb. 3, 2004 and entitled Method And System For Managing Vehicle Control Modules Through Telematics; 2) the Carver et al. U.S. Pat. No. 6,728,612 B1 issued Apr. 27, 2004 and entitled Automated Telematics Test System And Method; and 3) the Oesterling et al. U.S. Pat. No. 6,853,910 issued Feb. 8, 2005 and entitled Vehicle Tracking Telematics System.

As shown in FIG. 9A, a telematics unit or system 120 includes a digital signal processor (DSP) 122 connected to a wireless modem 124, a global positioning system (GPS) receiver or GPS unit 126, a memory 128, a microphone 130, one or more speakers 132, and an embedded or in-vehicle phone 134. DSP 122 is also referred to as a microcontroller, controller, host processor, or vehicle communications processor. Functions provided by GPS unit 126 include providing longitude and latitude coordinates of the vehicle. Furthermore, GPS unit 126 provides date and time information, within the accuracy of the GPS system. The in-vehicle or wireless phone 134 is selected from the group including, but not limited to, an analog, digital, dual-mode, dual-band, multi-mode or multi-band cellular phone. The telematics unit 120 includes an emergency warning system receiver 136, such as a radio receiver for receiving the right of way vehicle direct predefined signal of step 20 in FIG. 1. Instructions and commands 121 for putting into practice the present emergency warning system 10 can be embedded in the digital signal processor 122 such that the steps 16, 20, 34 and 40 shown in FIG. 1 can be practiced. The digital signal processor 122 has the capability of operating as the processor 60 of the present internal rear view mirror 12, cell phone 14, and CHMBL 15. The warning emitted by step 40 shown in FIG. 1 is emitted by the speaker 132 of the telematics unit 120.

The telematics unit or system 120 is part of a telematics access system that includes a mobile vehicle or car 138, one or more wireless carrier systems 140, one or more communications networks 142, one or more land networks 144, and one or more call centers 146.

Figure 9B:
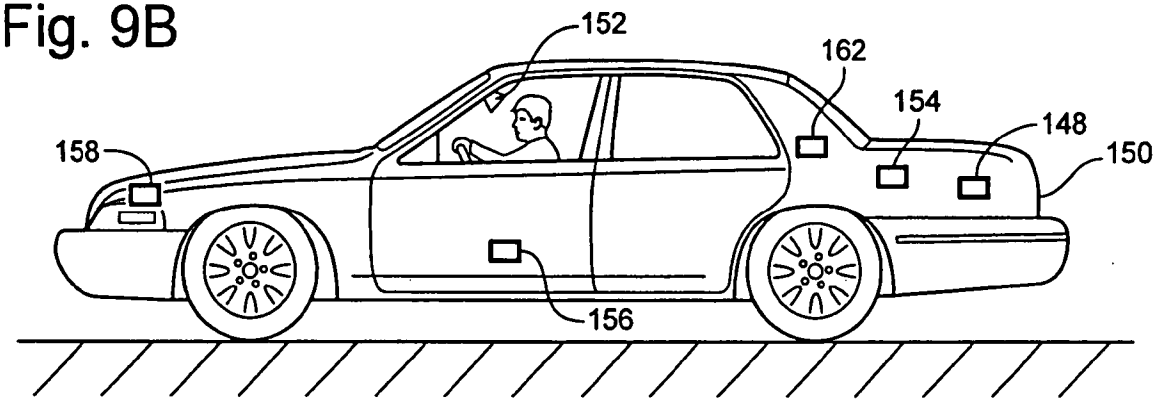
FIG. 9B shows a diagrammatic view of various portions of the telematics unit of FIG. 9A engaged to a vehicle.

Components or portions of the telematics unit or system 120 can be housed in a module 148 engaged in a rear of a vehicle 150, as shown in FIG. 9B, and such portions can include the processor 122, modem 124, GPS system 126, memory 128, portions of the phone 134, and emergency warning receiver 136. Further portions of the telematics unit or system 120 can be housed in a structure 152 in the passenger compartment of the vehicle 150 near the driver and such portions can include the microphone 130, the speaker 132, the phone 134 or portions of the phone 134, the emergency warning receiver 136 (and/or photosensitive cell 64) along with an operational button for the embedded cellular phone, a nonemergency button for calling up a call center 146 as to a nonemergency, and an emergency button for calling up a call center 146 as to an emergency. Such a structure 152 can be or include or be housed in a rear view mirror such as the rear view mirror 12 such that structure 152 includes housing 46, mirror 56, electrical or wireless circuit 58, antenna 62, speaker 42, battery 38, photosensitive cell 64, the emergency warning receiver 36 or 136, processor 60, and instructions for carrying out the emergency warning system or method 10 in the processor 60.

The telematics unit or system 120 can include a cellular antenna 154 on or in the vehicle 150. Antenna 154 can be a fixed mast cellular antenna.

The telematics unit or system 120 can include an automatic crash notification system having side crash sensors 156, front crash sensors 158, and a crash sensing diagnostic module 160.

The telematics unit or system 120 can: provide automatic notification of air bag deployment to the call center 146, provide remote door unlock services by a call to the call center 146, provide stolen vehicle tracking via GPS satellite technology, provide emergency services via a call to the call center 146 such that the call takes priority status, provide engine diagnostics, provide hands free calling on phone 134 via voice recognition software, provide a flashing of the exterior lights of vehicle 150 and a sounding of the horn of vehicle 150 via a call to the call center 146, provide advice on local weather, traffic and stocks, provide driving directions, and provide information on the locations of restaurants and hotels.

The present telematics unit or system 120 can include a cellular phone of about 3.0 watts.

The present telematics unit or system 120 can include a GPS antenna 162.

The present emergency warning system 10 and its hardware such as the photocell 64, can be physically located in or on a telematics unit 120 or in or on a portion of a telematics unit 120 with or without being tied into the circuitry of the telematics unit 120. Or the emergency warning system 10 can be tied partially into the telematics unit 120. For example, the emergency warning system 10 may or may not share a speaker (for an audible warning) or a display (for a visual warning) with the telematics unit.

One advantage of incorporating the present emergency warning system 10 into the telematics unit or system 120 is that the call center 146 can be notified when the emergency vehicle is approaching the vehicle 150 having the telematics unit or system 120. In other words, when the emergency warning receiver 136 picks up the right of way predefined direct signal from the emergency vehicle, the telematics unit or system 120 automatically communicates such a pick up to the call center 146. Thus the call center 146 has one further piece of information that may prove to be the piece that solves a who, where, what, why, or how puzzle of an emergency situation.

Figure 10A:
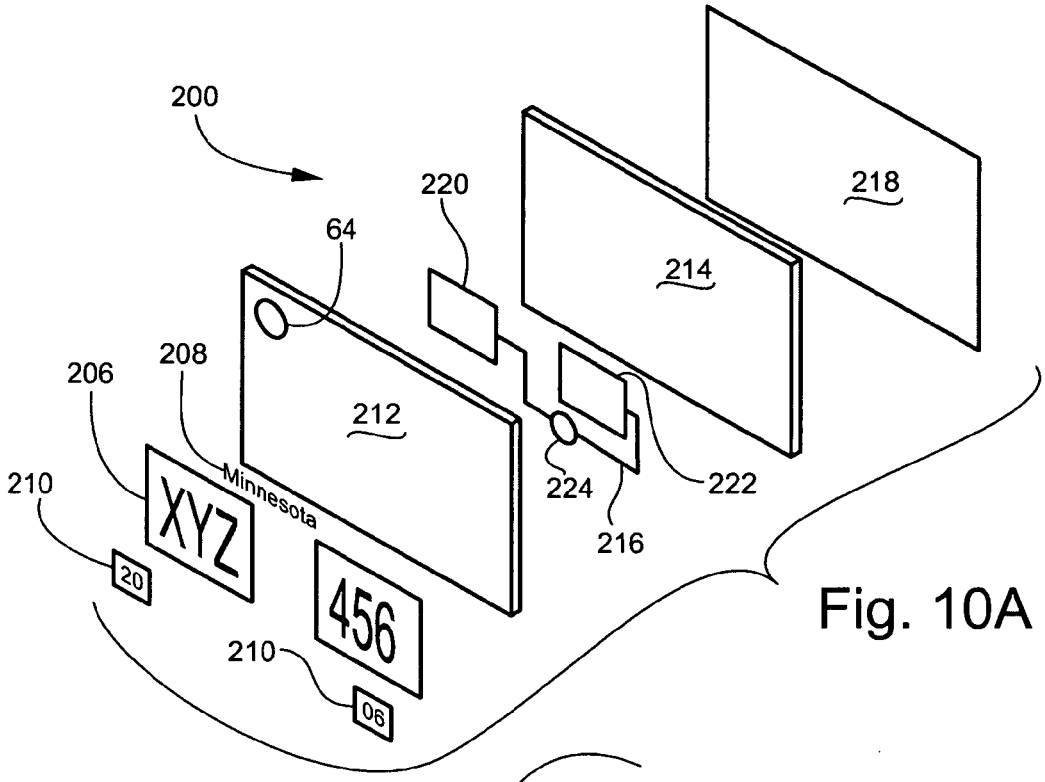
FIG. 10A is a broken apart perspective view of a license plate having at least a portion of an emergency warning system.

The Emergency Warning System 10 at Least Partially Incorporated into a License Plate or License Plate Holder FIG. 10A shows a license plate 200. License plate 200 includes a visual identification element 206 that provides unique information assigned to the automobile by authorities such as federal or state authorities. The visual identification element may be painted on, stuck on with tape, and/or embossed into the license plate. Further information on the license plate may include the issuing jurisdiction, such as state information 208 and year information 210.

License plate 200 includes retroreflective sheeting 212. Information 206, 208 and 210 is preferably engaged to a front side of retroreflective sheeting 212. Retroreflective sheeting 212 is any sheeting that does not inhibit the transmission of radio signals. As to such retroreflective sheeting that does not inhibit the transmission of radio signals, the Bantli et al. U.S. Pat. No. 5,621,571 issued Apr. 15, 1997 and entitled Integrated Retroreflective Electronic Display is hereby incorporated by reference in its entirety.

License plate 200 includes a dielectric substrate 214 in the form of a plate. An electronic circuit 216 is etched or printed on the dielectric substrate 214. As to the dielectric substrate 214, the Bantli et al. U.S. Pat. No. 5,621,571 issued Apr. 15, 1997 and entitled Integrated Retroreflective Electronic Display is hereby incorporated by reference in its entirety.

License plate 200 includes a ground plane or ground plate 218. Dielectric substrate 214 is engaged to the ground plane or plate 218.

License plate 200 can communicate via wires or wirelessly to an electronic module in the vehicle to which the license plate 200 is engaged, and/or license plate 200 can communicate via wires or wirelessly to a speaker and/or display in such vehicle for sounding a warning or displaying a warning, respectively. As to the license plate 200 being hard wired to an electronic module and/or battery in the vehicle to which it is engaged, the Bantli et al. U.S. Pat. No. 5,621,571 issued Apr. 15, 1997 and entitled Integrated Retroreflective Electronic Display is hereby incorporated by reference in its entirety.

The circuitry 216 of license plate 200 can include a processor 220 having circuitry for the steps of the emergency warning system 10, a radio receiver 222 responsive to the right of way predefined signal, a transmitter if desired to send a feedback signal to the right of way vehicle, a battery 224 such that the license plate 200 and emergency warning system 10 embedded therein is always on, information on verifying the right of way signal, and further information as desired for the steps of the emergency warning system 10 such as the steps shown in FIG. 1.

License plate 200 can include photosensitive cell or light receiver 64 on the retroreflective sheeting 212 for picking up a light emitted right of way signal. Photosensitive cell or light receiver 64 can be tied in to the circuitry 216.

If desired, license plate 200 can include one or more features of the emergency warning system 10. For example, license plate 200 can include merely one or more of an RF (radio) receiver and light receiver 64 and, with a minimum of circuitry 216, deliver information from such receiver or receivers to a module inside the vehicle to which the license plate 200 is engaged. Such a module, or different locations in such vehicle, can include a processor, battery, speaker, display, information, and other features of the emergency warning system 10.

By way of another example, license plate 200 can include a RF receiver and/or a light receiver 64, battery 224, along with a minimum of circuitry 216. Remaining components of emergency warning system 10 can be disposed in the vehicle to which the license plate 200 is attached, with the remaining components including a processor, and speaker and/or display.

Figure 10B:
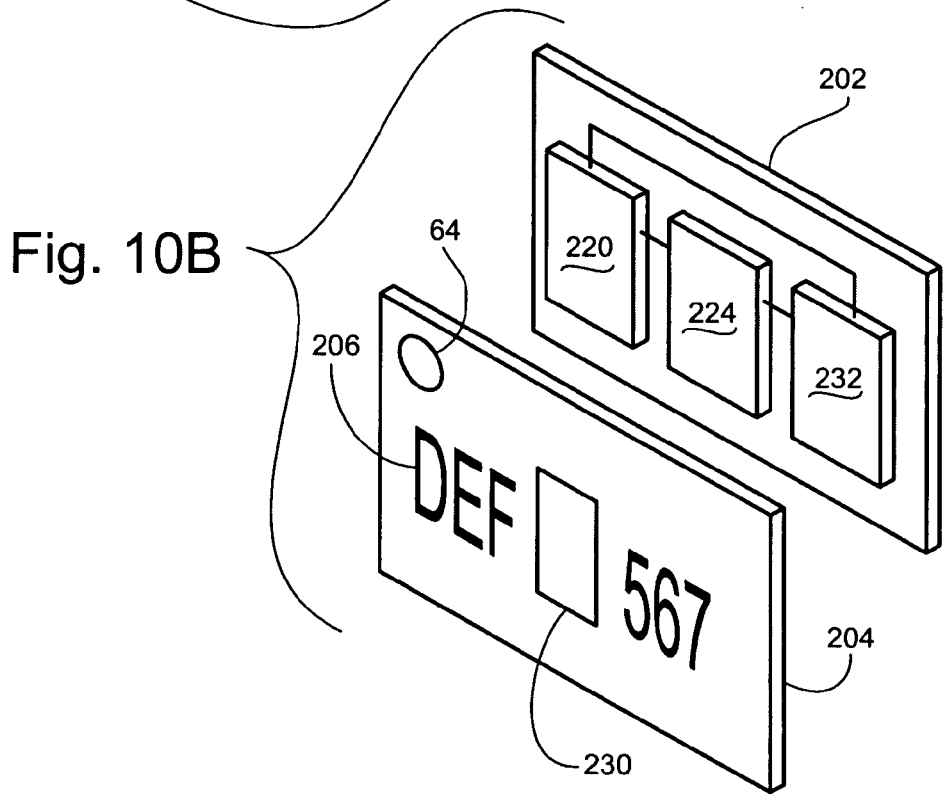
FIG. 10B is a broken apart perspective view of a license plate and license plate holder having at least a portion of an emergency warning system.

FIG. 10B shows a license plate 204 having a visual identification element 206 painted, taped, or embossed therein. License plate 204 is held in a license plate holder 202 that in turn is engaged to a vehicle. A front face of license plate 204 can include a radio receiver 230 and or a light receiver or photosensitive cell 64. If the license plate 204 includes retroreflective sheeting that does not inhibit the transmission of radio signals, the radio receiver 230 can be embedded in the license plate 204.

Radio receiver 230 and photosensitive cell 64 can communicate, such as via electric circuitry, with one or more features of the emergency warning system located in the license plate holder 202. Such features can include the processor 220, the battery 224, and a transmitter 232 such as for sending a feedback signal to the emergency vehicle that emitted the right of way signal. Further, if desired, the license plate holder 202 can include the photosensitive cell 64 disposed at a location unobstructed by license plate 204, such as at a peripheral location or at a location confronting an opening in the license plate 204. Also, if desired, the license plate holder 202 can include the radio receiver 230, such as where license plate 204 is formed of a material that does not inhibit the transmission of radio signals.

Further, if desired, license plate holder 202 and/or license plate 204 can include a minimum number of components of the emergency warning system 10, with such components including the radio receiver 230 and/or photosensitive cell 64 and a minimum amount of circuitry, with the remaining components of the emergency warning system 10 being disposed in the vehicle to which the license plate 204 and license plate holder 202 are attached, with such remaining components being one or more of the processor, battery, information, speaker and/or display. Also, as indicated with respect to license plate 200, emergency warning system components such as the receivers 230 and 64 and battery 224 can be disposed in one or more of the license plate 204 and license plate holder 202, with remaining components, such as the processor 220, being disposed inside of the vehicle to which the license plate 204 and license plate holder 202 are engaged.

It should be noted that license plate 204 and license plate holder 202 can include the features called out in the Bantli et al. U.S. Pat. No. 5,657,008 issued Aug. 12, 1997 and entitled Electronic License Plate Having A Secure Identification Device, which patent is hereby incorporated by reference in its entirety.

It should be noted that license plate 200 and license plate 204 and/or license plate holder 202 may include components of the other apparatus incorporating the emergency warning system 10, with the other apparatus including the rear view mirror 12, the cell phone 14, the third brake light 15, and the telematics unit or system 120.

Stand-alone Housing 300 having Emergency Warning System 10

Figure 11:
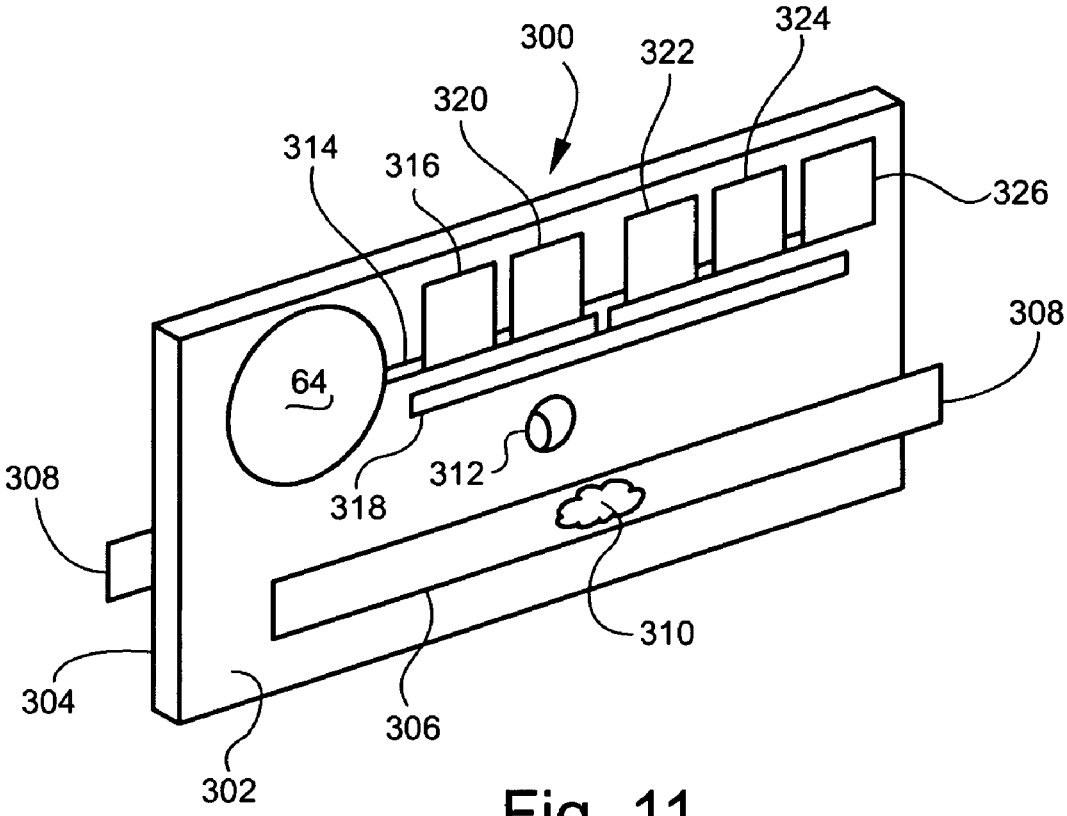
FIG. 11 is a perspective, partially broken away view, of a stand-alone housing apparatus having the present emergency warning system.

It should be noted that a stand-alone housing 300 having the emergency warning system 10 may be provided. This stand-alone housing 300 is shown in FIG. 11. Stand-alone housing 300 can be relatively small, with a size approximately that of a compact cell phone or a credit card. An advantage to the use of a stand-alone housing 300 is that it may be safer to, for example, have a third brake light 15 that remains as a simple, single purpose brake light, and simply adhesively secure stand-alone housing 300 to the third brake light 15.

Stand-alone housing 300 includes a first face 302 and a second face 304. Each of the faces 302, 304 includes adhesive tape 306 that includes a peel off strip 308 that, when peeled off, exposes adhesive 310 on the housing 300. Stand-alone housing 300 further includes a hole 312 for reception of a pin connector. Other means of attachment, such as a hook formed integrally and as one-piece with housing 300, may be used. Stand-alone housing 300, via such a hook, may hang from a location in a vehicle, such as from a rear view mirror or from an arm between a windshield and a rear view mirror. Stand-alone housing 300, via the adhesive 310, may be attached to the inner face of the rear window of a vehicle, or to another location on the inside or outside of a vehicle. Stand-alone housing 300, via the hole 312, may be attached to an outside face of a rear bumper of a vehicle, or to another location on the outside or inside of a vehicle. Stand-alone housing 300 may be formed in the shape of a cube or may include feet such that housing 300 does, in effect, stand alone without support. With utilization of adhesive 310 or pin connector hole 312, such a structure may be placed on the front dashboard or on the "dashboard" or rear shelf that confronts the rear window of a vehicle.

Stand-alone housing 300 is generally rectangular or parallelepiped and may include a thickness of between about 1.0 millimeters to about 3.0 centimeters, more preferably about 1.0 millimeters to about 2.0 centimeters, still more preferably about 1.0 millimeters to about 1.0 centimeters, and most preferably about 1.0 millimeters to about 5.0 millimeters. The length is preferably between about 4.0 centimeters to about 8.0 centimeters, more preferably about 5.0 centimeters to about 7.0 centimeters, and most preferably about 5.5 centimeters to about 6.5 centimeters. The width is preferably between about 1.0 centimeters to about 5.0 centimeters, more preferably about 2.0 centimeters to about 4.0 centimeters, and most preferably about 2.5 centimeters to about 3.5 centimeters.

Stand-alone housing 300 includes photosensitive cell 64 for exposure to a predefined right of way light signal from the right of way vehicle 18. Photosensitive cell 64 extends to the first and second face 302, 304 of the stand-alone housing 300 to maximize the chance that the predefined right of way light signal is picked up. Photosensitive cell 64 can also be formed so as to extend beyond an edge of the housing 300 such that the cell is omni-directional.

The stand-alone housing 300 further includes a) an electrical (perhaps wireless) circuit 314, b) a processor or microprocessor 316 having a circuit or steps or information for carrying out the emergency warning system 10 and being in communication with the circuit 314, c) a radio frequency (RF) antenna 318 for picking up a predefined right of way radio signal from a right of way vehicle 18, with the RF antenna or receiver 318 being in communication with the circuit 314, d) a speaker 320 in communication with the circuit 314, e) a battery 322 in communication with the circuit 314, f) if independent from the processor 316, instructions 324 for carrying out the emergency warning system or method 10 and being in communication with the circuit 314; and g) a radio transmitter 326 to, for example, communicate with the right of way vehicle 18 such as sending acknowledgement of receipt of the predefined right of way signal, with the radio transmitter being in communication with the circuit 314.

Hardware for the emergency warning system 10 can be engaged or housed wholly in the stand-alone housing 300. Or a portion of the hardware for the emergency warning system 10 can be engaged or housed in the stand-alone housing 300 and communicate in a wireless fashion to an electric module located in the vehicle, where such electric module includes another portion of the hardware for the emergency warning system 10, such as described with reference to license plate apparatus 200 and 204. For example, stand-alone housing 300 may include only a portion of components 306, 312, 64, 314, 316, 320, 322, 324 and 326. Stand-alone housing 300 may communicate in a wireless fashion with a speaker and/or display located somewhere else in the vehicle, whether or not stand-alone housing 300 includes speaker 320. However, it is preferable that the emergency warning system 10 is wholly contained in the structure of the stand-alone housing 300 itself such that the emergency warning system 10 is operable even before the stand-alone housing 300 is engaged somewhere in a vehicle such that the emergency warning system 10 is operable in a wallet or purse.

It is preferable that stand-alone housing 300 is engaged at a relatively high location in the vehicle. Such relatively high locations include a rear view mirror or a support for the rear view mirror, an upper portion of the front windshield or an upper portion of a rear window, or the back of a headrest such as the back of a headrest for a front seat of the vehicle or adjacent or on a CHMBL 15, whether the CHMBL 15 is mounted on an upper or lower portion of a rear window.

It should be noted that any one of the apparatus 12, 14, 15, 120, 200, 202, 204, or 300 can have, if desired, one or more features of any of the other apparatus 12, 14, 15, 120, 200, 202, 204, or 300.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A license plate apparatus for engagement to a vehicle having at least one of a speaker and display in said vehicle, with said license plate apparatus comprising:

a) a license plate adaptable for engagement to the vehicle, with said license plate having a visual identification element thereon;

b) an electrical circuit in the license plate, with said electrical circuit being in communication with said at least one speaker and display in said vehicle;

c) a processor engaged in one of said license plate, a license plate holder, and vehicle and being in communication with said electrical circuit;

d) an emergency warning system for picking up a right of way vehicle predefined direct strobe light signal which includes pulses of light, with the emergency warning system being engaged in one of the license plate, license plate holder and vehicle and being in communication with said electrical circuit, with the emergency warning system comprising a photocell receiver responsive to said right of way vehicle predefined direct strobe light signal, and with the emergency warning system emitting, when said right of way vehicle predefined direct strobe light signal has been picked up, at least one of an audio warning via said speaker and a visible warning via said display;

e) wherein said photocell receiver is engaged with said license plate; and f) with the emergency warning system verifying said right of way vehicle predefined direct strobe light signal, and with the emergency warning system verifying said right of way predefined direct strobe light signal by counting pulses of the right of way vehicle predefined direct strobe light signal.

2. The license plate apparatus of claim 1, wherein said processor is engaged in said license plate.

3. The license plate apparatus of claim 1, wherein said processor is adaptable for engagement in said vehicle.

4. An emergency warning apparatus for a vehicle having at least one of a speaker and display, comprising:

a) a license plate having a visual identification element;

b) a photocell receiver responsive to a right of way vehicle predefined direct strobe light signal which includes pulses of light, with said photocell receiver being engaged with one of said license plate and a license plate holder;

c) a processor engaged with one of said license plate, license plate holder, and vehicle, with said processor being in communication with said photocell receiver, with said processor being in communication with said at least one speaker and display, with said processor including an emergency warning system for picking up a right of way vehicle predefined direct strobe light signal via said photocell receiver, with the emergency warning system emitting, when said right of way vehicle predefined direct strobe light signal has been picked up, at least one of an audio warning via said speaker and a visible warning via said display; and d) with the emergency warning system verifying said right of way vehicle predefinod direct strobe light signal, and with the emergency warning system verifying said right of way predefined direct strobe light signal by counting pulses of the right of way vehicle predefined direct strobe light signal.

5. The emergency warning apparatus of claim 4, wherein said processor is engaged in said license plate.

6. The emergency warning apparatus of claim 4, wherein said processor is adaptable for engagement in said vehicle.

7. An apparatus shaped generally about a size of a credit card and having incorporated therein an emergency warning apparatus responsive to a predefined right of way direct strobe light signal from an emergency vehicle, with said apparatus comprising:

a) a housing, with the housing having a thickness of between about 1.0 millimeters and about 3.0 centimeters, a length between about 4.0 centimeters and about 8.0 centimeters, and a width between about 1.0 centimeters and about 5.0 centimeters;

b) a processor in the housing and in communication with a circuit;

c) a photocell receiver in the housing and in communication with the circuit;

d) an emergency warning system in the housing and in communication with the circuit, with the emergency warning system picking up a right of way vehicle predefined direct strobe light, signal, which includes pulses of light, via said photocell receiver, with the emergency warning system emitting, when said right of way vehicle predefined direct strobe light signal has been picked up, at least one of an audio warning via a speaker and a visible warning via a display; and e) with the emergency warming system verifying said right of way vehicle predefined direct strobe light signal, and with the emergency warning system verifying said right of way predefined direct strobe light signal by counting pulses of the riqht of way vehicle predefined direct strobe light signal

8. The apparatus of claim 7 and further comprising said speaker, with said speaker being in the housing and in communication with the circuit.

* * * * *